United States Patent [19]

Ishii et al.

[11] Patent Number: 4,907,546

[45] Date of Patent: Mar. 13, 1990

[54] AIR-COOLED TYPE COOLING SYSTEM FOR ENGINE WORKING MACHINE ASSEMBLY

[75] Inventors: Akira Ishii; Koji Iwai; Ryoichi Ito; Osamu Murakami, all of Sakaishi, Japan

[73] Assignee: Kubota Ltd., Osaka, Japan

[21] Appl. No.: 273,836

[22] Filed: Nov. 21, 1988

[30] Foreign Application Priority Data

Dec. 2, 1987 [JP] Japan ..... 62-306250
Dec. 2, 1987 [JP] Japan ..... 62-184798[U]
Dec. 9, 1987 [JP] Japan ..... 62-312506

[51] Int. Cl.[4] ..... F01P 1/00

[52] U.S. Cl. ..... 123/41.56; 123/2; 123/41.66; 123/41.69; 123/41.7; 60/320; 181/262; 290/1 B; 310/62

[58] Field of Search ..... 123/2, 3, 41.31, 41.56, 123/41.65, 41.66, 41.69, 41.7, 198 E; 60/316, 319, 320; 290/1 B; 310/60 R, 62, 63, 58, 59; 181/204, 262, 263

[56] References Cited

U.S. PATENT DOCUMENTS 1,331,649 2/1920 Kettering ..... 123/41.66
2,543,541 2/1951 Angle ..... 290/1 B
2,737,774 3/1956 Stiers ..... 60/320
4,677,940 7/1987 Bracht et al. ..... 123/2
4,779,905 10/1988 Ito et al. ..... 123/2

FOREIGN PATENT DOCUMENTS 197417 11/1983 Japan ..... 123/2

*Primary Examiner*—Noah P. Kamen
*Attorney, Agent, or Firm*—Lowe, Price, LeBlanc, Becker & Shur

[57] ABSTRACT

In an air-cooled type cooling system for an engine working machine assembly in which a working machine such as a generator, a compressor and the like is adapted to be driven by an internal combustion engine, there are provided an air-cooled engine, a working machine and an exhaust muffler in a machine area as well as a centrifugal cooling fan in a fan room within a casing. An exhaust air outlet passage and an exhaust air conduction passage are provided in such a manner as to come out in parallel from the periphery of the fan area. Part of the cooling air sucked into the fan area after cooling the engine and the working machine in the machine area is adapted to be discharged directly outside the casing through the exhaust air outlet passage, and the remaining part thereof is adapted to be discharged outside the casing through the exhaust air conduction passage after cooling the exhaust muffler.

3 Claims, 5 Drawing Sheets

AIR-COOLED TYPE COOLING SYSTEM FOR ENGINE WORKING MACHINE ASSEMBLY

BACKGROUND OF THE INVENTION

1. Field of the Invention

The present invention relates to an engine working machine assembly in which a working machine such as a generator, a compressor and the like is adapted to be driven by an internal combustion engine and more specifically to an air-cooled type cooling system for an engine working machine assembly which employs an air-cooled engine as an internal combustion engine.

2. Prior Art

A conventional engine working machine assembly is disclosed in U.S. Pat. No. 2,543,541 (Patented Feb. 27, 1951). In this engine working machine assembly, a machine area and a fan area are partitioned within a casing thereof. A radial internal combustion engine (simply referred to as an engine hereinafter) and a generator are disposed within the machine area, and an axial fan is disposed within the fan area. a ventilation inlet opened to the fan area is in communication with an exterior space outside the casing through the fan area and the machine area so that cooling air can be delivered by the axial fan to the engine as well as the generator in the machine area and cool them therein.

As a means for reducing noise of the engine working machine assembly having the construction mentioned above, the following is known by the inventors of the present invention.

An exhaust muffler and a muffler cover are arranged in the machine area so that the exhaust muffler is accommodated within the muffler cover to provide a muffler cooling air passage therebetween, and the muffler cooling air passage and the exterior space outside the casing are connected in series with the interior space within the machine area. First the cooling air is delivered by the axial fan to the machine area to cool the engine and the generator therein and then to the muffler cooling air passage to cool an exhaust gas. Accordingly, a volumetric flow of the exhaust gas is decreased so as to reduce the noise of the exhaust gas.

However, in this case, since the flow resistance of the cooling air gets large by the amount thereof flowing through the muffler cooling air passage, the quantity of the cooling air gets decreased thereby correspondingly and cooling efficiency for the engine and the generator gets lowered disadvantageously.

SUMMARY OF THE INVENTION

It is an object of the present invention to cool an engine and working machine efficiently as well as to reduce a noise of an engine working machine assembly.

For accomplishing the above-mentioned object, an air-cooled type cooling system for an engine working machine assembly is constructed as follows.

Within a casing, there are disposed an engine, a working machine, an exhaust muffler and a muffler cover in a machine area as well as a centrifugal cooling fan in a fan area. A ventilation inlet is opened into said machine area and an air suction opening is opened into said fan area so that the ventilation inlet of the machine area, the interior space thereof and the air suction opening of the fan area are communicated in series with one another. Further, an exhaust air outlet passage and an exhaust air conduction passage are provided in parallel along a peripheral wall of the fan room. The outlet of the exhaust air outlet passage directly communicates with the atmostphere, and the outlet of the exhaust air conduction passage is communicated with the atmosphere through the muffler cooling air passage within the muffler cover.

According to this arrangement, the cooling air is adapted firstly to be sucked into the fan room from the ventilation inlet of the machine area through the interior space thereof, then to be divided into the exhaust air outlet passage and the exhaust air conduction passage from the interior of the fan area. It is then discharged outside the casing from the outlet of the exhaust air outlet passage directly as well as from the exhaust air conduction passage through the muffler cooling air passage.

A flow resistance of the cooling air is reduced differently from the conventional assembly in which the whole quantity of the cooling air is adapted to flow through the muffler cooling air passage. Therefore, a sufficient quantity of cooling air can be passed through the interior space of the machine area to cool the engine and the working machine efficiently. Since the cooling air is so as passed through the muffler cooling air passage so as to cool the exhaust gas within the muffler, exhaust noise of the engine as well as leakage of the engine running noise from the casing is reduced.

Accordingly, the engine and the working machine can be cooled efficiently and the noise of the engine working machine assembly can be reduced.

A further modification is as follows.

The fan area is disposed at the upper side of the machine area, and a vertical shaft type engine is employed. A working machine and a cooling fan are arranged in series above the engine and are connected interlockingly with the engine. Further, an upper ventilation area is provided above the fan room so as to be in communication with the upper portion of the machine area, and an auxiliary air suction opening is formed in the upper wall of the fan area so that the upper ventilation area is in communication with the fan room through the auxiliary air suction opening.

According to this arrangement, cooling air is adapted to be sucked into the fan area from the ventilation inlet of the machine area after passing upwardly through the interior space of the machine area and sucked into the fan area from the upper space of the machine area through the upper ventilation area and the auxiliary air suction opening.

Since the cooling air is sucked upwardly in the interior space of the machine area, the direction in which the cooling air is subjected to a buoyancy owing to the heat from the engine and the working machine and the sucking direction coincide with each other so that the cooling air can flow smoothly in the machine area and cool the engine and the working machine intensively. Since the air in the upper space of the machine area is sucked into the fan area through the upper ventilation area and the auxiliary air suction opening and is discharged outside, hot air can be prevented from stagnating in the upper space of the machine area and the interior of the casing can be kept at a low temperature so that the life of the control device for the engine can be lengthened.

A further modification of the invention is as follows.

The exhaust air conduction passage is formed to come out of the fan room horizontally, the outlet of the exhaust air conduction passage is opened downwardly at the upper side of the muffler cooling air passage, and a guide plate for changing the exhaust air direction is provided at the upper side of the outlet of the exhaust air conduction passage inside thereof in a slant manner to lower itself in the exhaust air flowing direction.

Therefore, the cooling air sucked into the fan room flows horizontally in the exhaust air conduction passage, and then the flowing direction thereof is changed downwardly along the guide plate so as to be guided smoothly toward the outlet of the exhaust air conduction passage. Accordingly, the flow resistance of the cooling air can be reduced and the cooling air can be passed through the muffler cooling air passage sufficiently. Further, the exhaust noise can be reduced by cooling an exhaust gas sufficiently and the heat quantity radiated from the muffler and the muffler cover is decreased.

In this case, since it is enough to only provide the guide plate for changing the exhaust air flowing direction in the exhaust air conduction passage and it is not necessary to form the downstream portion of the exhaust air conduction passage in an elbow-like configuration or to mount an elbow-like member separately, the exhaust air conduction passage can be manufactured readily.

BRIEF DESCRIPTION OF THE DRAWINGS

FIG. 1 is a vertical sectional front view of a portable engine generator as an engine working machine assembly;

FIG. 2 is a front view of the engine generator;

FIG. 3 is a partially sectional left side view of the engine generator;

FIG. 4 is a sectional view on IV—IV directed bent line in FIG. 1;

FIG. 5 is a sectional view on V—V directed line in FIG. 1;

FIG. 6 is a partially sectional view showing a muffler unit on VI—VI directed bent line in FIG. 5;

FIG. 7 is a rear view of the muffler unit; and

FIG. 8 is a plan view of the muffler unit.

DESCRIPTION OF THE PREFERRED EMBODIMENT

One embodiment of the present invention is applied to a portable engine generator and will be explained with reference to the drawings.

Figure 1:
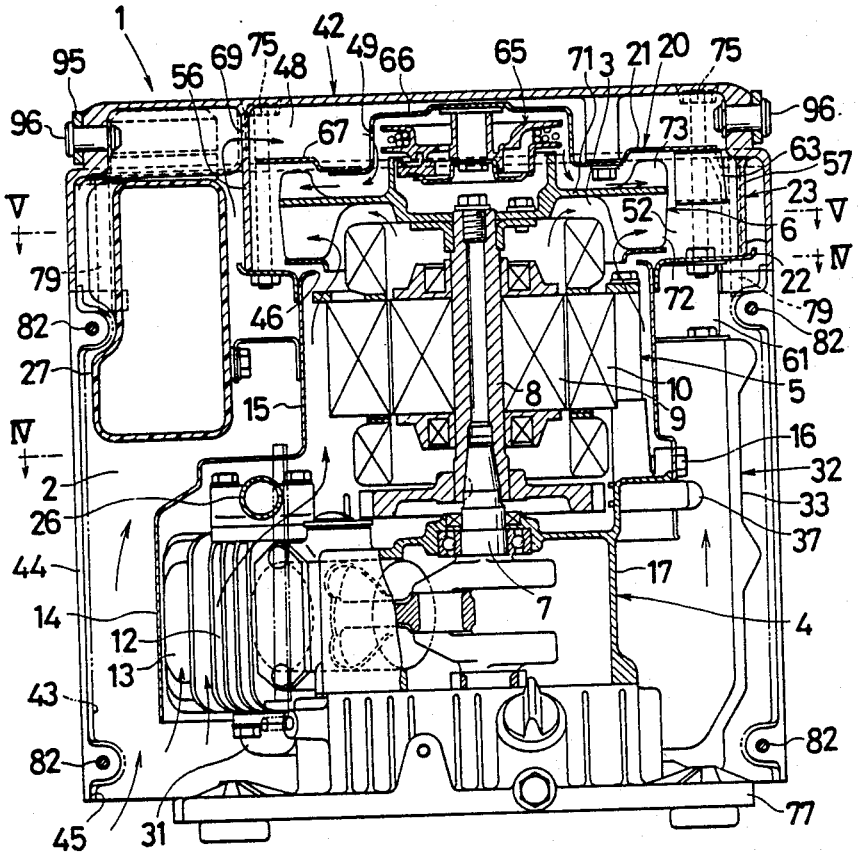
FIGS. 1 through 8 show an embodiment of the present invention.

As shown in FIG. 1, an interior space of a soundproof casing 1 of an engine generator is partitioned to a machine room 2 at the lower side thereof 1 and to a fan area 3 at the upper side thereof. A vertical shaft type air-cooled engine 4 is disposed in the lower portion of the machine area 2, and a generator (a working machine) 5 is disposed above the engine 4. A centrifugal cooling fan 6 is disposed in the fan area 3. Generator 5 and cooling fan 6 are connected interlockingly with the engine 4. That is, the rotation shaft 8 of the generator 5 is fixedly secured to the upper portion of the crank shaft 7 of the engine 4, and the stator 10 thereof 5 is fixedly mounted so as to encircle the rotor 9 fixedly secured to the rotation shaft 8. Further, the cooling fan 6 is fixedly secured to the upper end portion of the rotation shaft 8.

Figure 4:
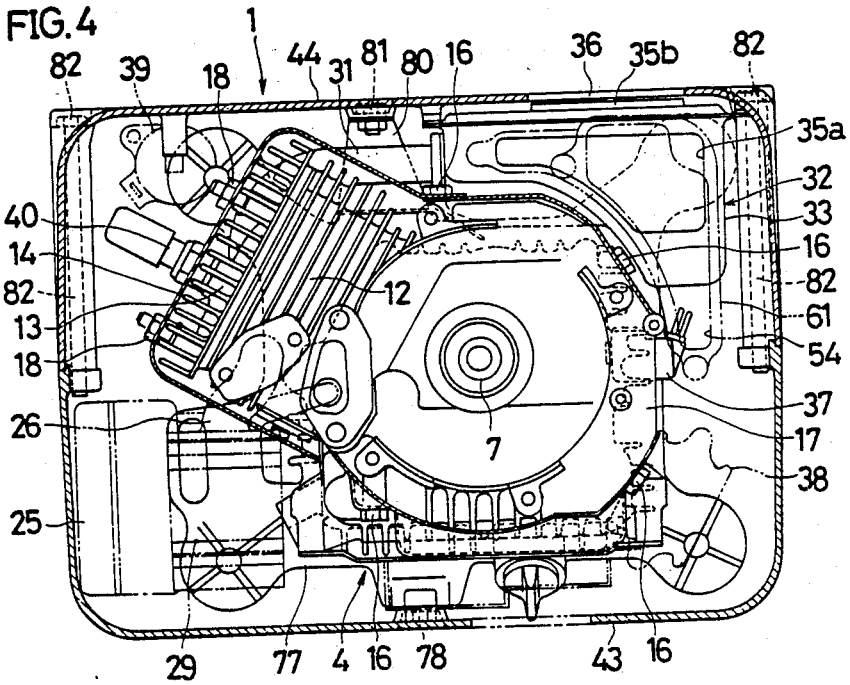

The outer periphery of the cylinder 12 and the cylinder head 13 of the engine 4 is covered by a cooling air guide cover 14 for the engine 4, and the outer periphery of the generator 5 is covered by a cooling air guide cover 15 for the generator 5. These cooling air guide covers 14, 15 are formed integrally and fixedly secured to the crankcase 17 of the engine 4 by means of a plurality of bolts 16 as well as to the cylinder head 13 by means of a plurality of nuts 18 (FIG. 4). The cooling fan 6 is covered by a fan case 20 which partitions the fan area 3. The fan case 20 comprises an upper wall portion 21, a lower wall portion 22 and a peripheral wall portion 23 and is fixedly secured at its lower wall portion 22 to the cooling air guide cover 15 for the generator 5.

In an exterior space outside the cooling air guide covers 14, 15 within the machine room 2, there are the following various kinds of devices.

Figure 2:
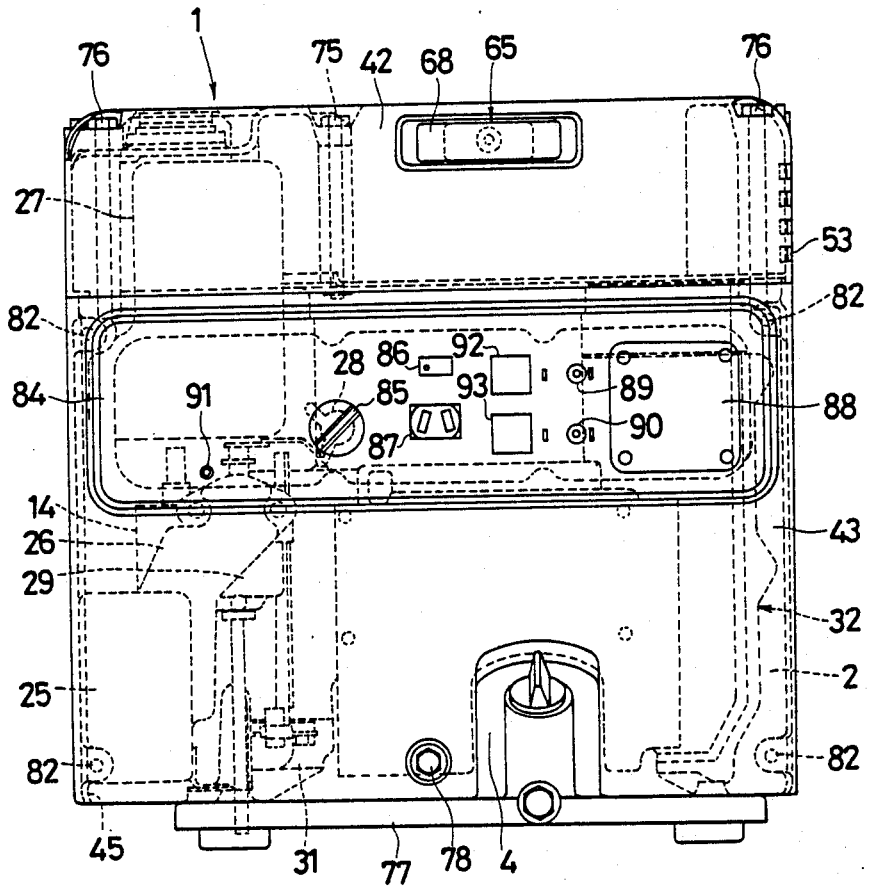

As shown in FIG. 2 and FIG. 4, at the left side of the cooling air guide cover 14 for the engine 4, there are arranged an intake device equipped with an air cleaner 25 and an intake pipe 26 as well as a fuel supply system equipped with a fuel tank 27, a fuel cock 28 and a carburetor 29.

Figure 8:
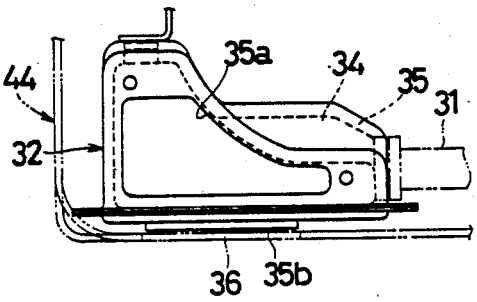
Figure 6:
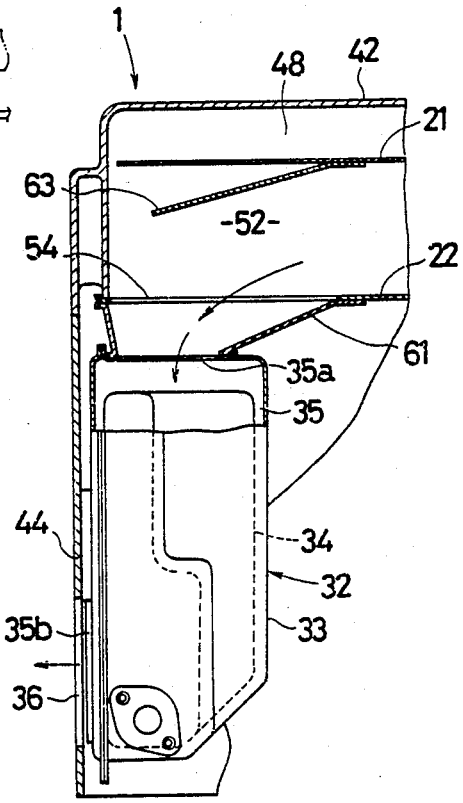
Figure 7:
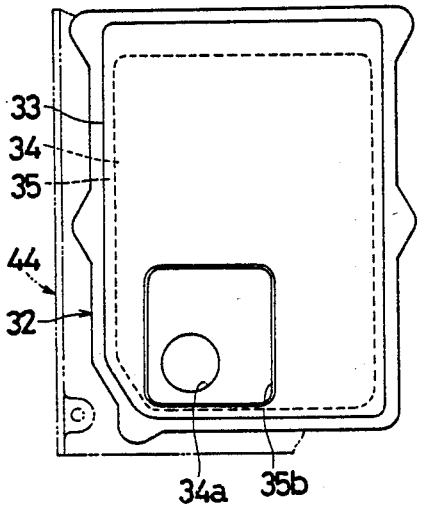

An exhaust pipe 31 and a muffler unit 32 are disposed at the back side of the cooling air guide cover 15 for the generator 5. As shown in FIGS. 6 through 8, the muffler unit 32 comprises a muffler cover 33 and an exhaust muffler 34 which is accommodated therewithin 33 through a muffler cooling air passage 35. The inlet **35*a* of the muffler cooling air passage 35 is opened in the upper portion of the muffler cover 33 and the outlet 35*b* thereof 35 is opened in the back and lower portion of the muffler cover 33. The exhaust gas outlet 34*a* of the exhaust muffler 34 is opened inside of the outlet 35*b* of the muffler cooling air passage 35. A discharge outlet 36 is provided in the casing 1 corresponding to the positions of the outlet 35*b* of the muffler cooling air passage 35 and the exhaust gas outlet 34*a***.

Further, as shown in FIG. 4, around the periphery of the cooling air guide cover 14 for the engine 4, there is provided a spark-ignition system equipped with a rotary sensor 37, a capacitor-discharge type ignition device (a CDI device) 38, an ignition coil 39, and an ignition plug 40.

Figure 3:
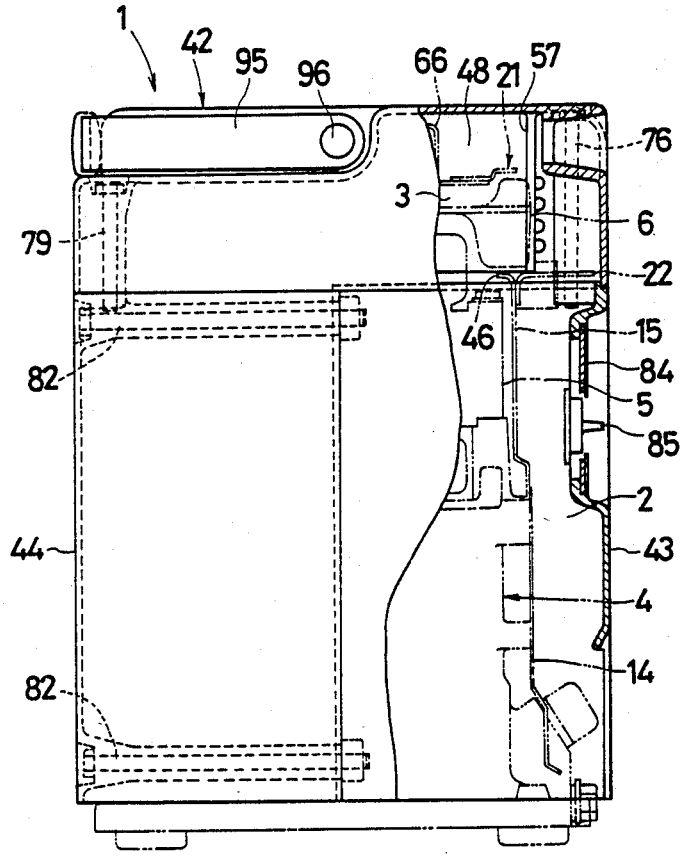

As shown in FIG. 2 and in FIG. 3, the casing 1 made of synthetic resin is as whole formed in a rectangular parallelepiped configuration having an opened bottom and comprises an upper side casing portion 42 for covering the upper portion of the engine generator, a front side casing portion 43 for covering the front half portion of the lateral periphery thereof, a back side casing portion 44 for covering the back half portion of the lateral periphery thereof.

Figure 5:
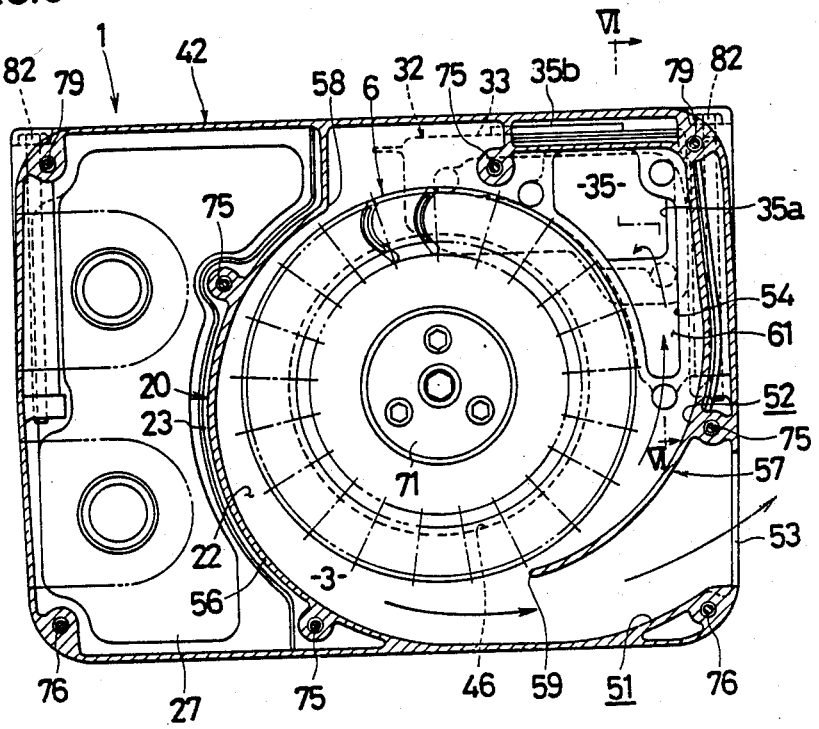

As shown in FIG. 1, a ventilation inlet 45 is provided for the machine room 2 by the opened bottom of the casing 1, and an air suction opening 46 is provided for the fan room 3 by opening the upper side of the cooling air guide cover 15 for the generator 5 so as to face the machine room 2. Accordingly, the lower space within the casing 1 is in communication with the exterior space outside the casing 1 through the interior spaces within the cooling air guide cover 14 for the engine 4 as well as the cooling air guide cover 15 for the generator 5 and the fan room 3. Further as shown in FIG. 5, an exhaust air outlet passage 51 and an exhaust air conduction passage 51 are formed in such a manner as to come out of the periphery of the fan room 3 in parallel within the fan case 20. The outlet 53 of the exhaust air outlet passage 51 is in communication with the atmosphere as well as the outlet 54 of the exhaust air conduction passage 52 is in communication with the muffler cooling air passage 35 within the muffler cover 33.

The constructions of the fan case 20 and the cooling fan 6 will be explained more specifically with reference to FIG. 1 and FIG. 5.

As shown in FIG. 5, the peripheral wall portion 23 of the fan case 20 is formed integrally with the upper side casing portion 42 inside thereof 42. The peripheral wall portion 23 is provided with a first cooling air guide wall 56 at the left side thereof 23 and with a second cooling air guide wall 57 at the right side thereof 23. The first cooling air guide wall 56 at the left side is formed in such a vortex shape as to gradually get remoter from the cooling fan 6 in a direction of rotation (in this case, in a direction of counterclockwise rotation) between a first cut off point 58 located at the left and back position of the cooling fan 6 and the front side of thereof 6. The second cooling air guide wall 57 at the right side is formed in such a vortex shape as to gradually get remoter therefrom 6 in a direction of rotation between a second cut off point 59 located at the right and front position of the cooling fan 6 and the right and back side thereof 6.

Between the second cooling air guide wall 57 at the right side and the front wall of the upper side casing portion 42, there is provided the exhaust air outlet passage 51 extending horizontally. And the outlet 53 thereof 51 is opened at the right and front position of the upper side casing portion 42. Inside of the second cooling air guide wall 57, there is provided the exhaust air conduction passage 52 extending horizontally from the fan room 3. The outlet 54 of the exhaust air conduction passage 52 is provided in the lower wall portion 22 of the fan case 20 and is in communication with the inlet 35*a* of the muffler cooling air passage 35 of the muffler unit 32 through an exhaust air duct 61.

As shown in FIG. 6 and FIG. 1, for further guiding smoothly to the outlet 54 of the exhaust air conduction passage 52 a cooling air guided thereby 52, a guide plate 63 for changing the flow direction of the exhaust air is provided at the upper side of the exhaust air conduction passage 52 inside thereof 52. The guide plate 63 is fixedly secured to the upper wall portion 21 of the fan case 20 and has such a shape that its area projected in a pan view gets larger in a direction of getting near to the lower wall portion 22 of the fan case 20 along the flow direction of the exhaust air (refer to FIG. 1). The opening area of the outlet 54 of the exhaust air conduction passage 52 is generally the same as the area of the guide plate 63 projected in the plane view and gradually gets larger in a direction toward the back side of the casing 1 as shown in FIG. 5. Therefore, the passage area narrowed by the guide plate 63 in the exhaust air conduction passage 52 is complemented.

As shown in FIG. 1, in the fan area 3 of the fan case 20, there is provided a recoil starter 65 coaxially with the cooling fan 6 thereabove 6. A mounting plate 66 for the starter 65 and a guide plate 67 protruding from the periphery of the mounting plate 66 comprise the upper wall portion 21 of the fan case 20. A starter handle 68 for the recoil starter 65 is provided in the upper side casing portion 42 in a projecting manner (refer to FIG. 2). Between the upper wall portion 21 of the fan case 20 and the upper side casing portion 42, there is provided an upper ventilation area 48 which is in communication with the upper portion of the machine area 2 through a plurality of vent openings 69. These vent openings 69 are provided in the upper portion of the right and left cooling air guide walls 56, 57 with a predetermined separation distance in their peripheral directions. And the upper ventilation area 48 and the fan area 3 are in communication with each other through an auxiliary air suction opening 49.

The cooling fan 6 is of a type having upper and lower suction portions and equipped with a rotation plate 71 to be connected to the generator 5, a lower side fan 72 provided on the lower surface of the rotation plate 71 and an upper side fan 73 provided on the upper surface thereof 71. The lower side fan 72 serves to suck the air from the machine area 2 into the fan room 3 through the air suction opening 46. The upper side fan 73 serves to suck the air within the upper space of the machine area 2 through the vent opening 69, the upper ventilation area 48 and the auxiliary air suction opening 49.

The assembly procedure of the casing 1 will be explained with reference to FIGS. 1 through 4 hereinafter. That is, the left and right air guide walls 56, 57 of the upper side casing portion 42 are placed on the lower wall portion 22 of the fan case 20, and four bolts 75 vertically inserted through the upper side casing portion 42 are threadably engaged with the lower wall portion 22 of the fan case 20 so that the upper side casing portion 42 can be fixedly secured to the engine 4 through the cooling air guide cover 15 for the generator 5 and the cooling air guide cover 14 for the engine 4. The front casing portion 43 is fixedly secured at its upper left and right locations to the front portion of the upper side casing portion 42 by means of two through-bolts 76 and at its lower central locations to the base 77 of the engine 4 by means of a bolt 78. Similarly the back side casing portion 44 is fixedly secured at its upper left and right locations to the back side of the upper side casing portion 42 by means of two through-bolts 79 and at its lower central location to the base 77 of the engine 4 through a bracket 80 by means of a bolt 81. Further, the back side casing portion 44 is fixedly secured at its opposite sides to the front side casing portion 43 by means of four through-bolts 82.

As shown in FIG. 2 and FIG. 3, an operation panel 84 is arranged at the upper side of the front side casing portion 43. The operation panel 84 is provided with the following component parts. That is, there are provided the fuel cock 28, an operation dial 85 for a choke valve (not illustrated), an operation switch 86 for starting and stopping the engine 4, a direct current plug socket 87 for battery charging, an alternating current plug socket 88, circuit breakers 89, 90 for an alternating current output circuit and for a general direct current output circuit, a ground terminal 91, a pilot lamp 92 and an alarm lamp 93 for a shortage of oil. A handy handle 95 for carrying is attached vertically swingably to the opposite side walls of the upper side casing portion 42 by means of pivot pins 96, 96.

In the engine generator as constructed above, when the cooling fan 6 is driven by the engine 4, the air within the casing 1 is adapted to be sucked into the fan area 3 through the air suction opening 46 after cooling the engine 4 and the generator 5 while passing through the cooling air guide cover 14 for the engine 4 and the cooling air guide cover 15 for the generator 5 as shown by a solid directed line in FIG. 1. The air within the casing 1 is adapted to be sucked into the fan room 3 from the upper space of the machine room 2 through the vent opening 69, the upper ventilation room 48 and the auxiliary air suction opening 49 after cooling a fuel tank 27, the intake device, an exhaust device, the ignition system and the operation panel 84 which are all arranged outside the cooling air guide covers 14, 15.

Since the air is adapted to be sucked from the upper space of the machine room 2 to the fan room 3 in that way, hot air is prevented from stagnating in the upper space of the machine area 2.

The air sucked into the fan area 3 is discharged outside the fan area 3 by means of the cooling fan 6. Thereupon, as shown in FIG. 5, the air discharged by means of the cooling fan 6 between the first cut off point 58 and the second cut off point 58 is discharged directly outside the casing 1 through the exhaust air outlet passage 51. The air discharged by means of the cooling fan 6 between the second cut off point 59 and the first cut off point 58 is supplied to the muffler cooling air passage 35 through the exhaust air conduction passage 52. In this case, since the distance wherein the cooling air is guided from the first cut off point 58 to the second cut off point 59 can be short and the distance wherein the cooling air is guided from the second cut off point 59 to the first cut off point 58 can be short, the flow resistance of the cooling air within the fan room 3 gets smaller. Therefore, a sufficient quantity of cooling air can be obtained, and the cooling efficiency for the engine 4 and the generator is high.

Since a portion of the cooling air delivered by the cooling fan 6 is adapted to be discharged outside the casing 1 from the exhaust air conduction passage 52 through the muffler cooling air passage 35, the engine running noise within the casing 1 hardly leaks outside the casing 1. The soundproofing becomes more effective because the exhaust gas within the exhaust muffler 34 is cooled to lower the exhaust gas noise differently from the conventional assembly in which the whole quantity of the cooling air delivered by the cooling fan 6 is discharged from the fan room 3 to the outside of the casing 1. Since the flow resistance can be small differently from the conventional assembly in which the whole quantity of cooling air delivered by the cooling fan 6 is discharged outside the casing 1 through the muffler cooling air passage 35, a sufficient cooling air can be obtained. Further if the muffler unit 4 is provided within the casing 1, an amount of heat radiated from the muffler unit 4 is reduced by the cooling of the muffler unit 4 and the cooling efficiency for the whole engine generator can be kept high.

Instead of the vertical shaft type engine employed as the engine 4 in this embodiment, a horizontal shaft type engine may be employed.

Since the tandem interlocking connection of the engine 4, the generator 5 and the cooling fan 6 is not an essential matter for the present invention, the cooling fan 6 may be driven by an electric motor provided separately from the engine 4 and the generator 5. The cooling fan 6 may be interlockingly connected to the engine 4 or to the generator 5 through a transmission means such as a belt type transmission device, a chain type transmission device and a geared transmission device.

The cooling fan 6 may be modified as follows. Instead of the provisions of the lower side fan 72 and the upper side fan 73, one of fans 72, 73 may be eliminated and the air suction opening 46 and the auxiliary air suction opening 49 may be so rearranged that the other fan can suck the air through both them 46, 49.

Further, the peripheral wall portion 23 of the fan case 20 may be formed by another member which is separate from the casing 1.

A compressor to be driven by the engine 4 may be employed instead of the engine working machine assembly in which the generator 5 is adapted to be driven by the engine 4.

We claim:

1. In an air-cooled type cooling system for an engine working machine assembly including;

a casing, an air-cooled engine, a working machine, a centrifugal cooling fan, an exhaust muffler of the engine and a muffler cover thereof;

said casing comprising a machine area and a fan area partitioned therewithin, said machine area comprising said engine, said working machine and said muffler cover, said exhaust muffler being accommodated within the muffler cover through a muffler cooling air passage; said fan area being provided with a centrifugal cooling fan;

a ventilation inlet in said machine area, an air suction opening in said fan area facing said machine area, an exhaust air outlet passage and an exhaust air conduction passage extending in parallel from the periphery of said fan room;

the outlet of said exhaust air outlet passage being in communication with the atmosphere, and the outlet of said exhaust air conduction passage being in communication with the muffler cooling air passage within the muffler cover.

2. An air-cooled type cooling system for an engine working machine assembly as recited in claim 1, wherein the fan area is provided above the machine area, said engine comprises a vertical shaft type engine; said working machine and said cooling fan are arranged in series above the engine, said machine and said cooling fan interlockingly connected to the engine;

an upper ventilation area provided above the fan area, the upper ventilation area in communication with the upper portion of said machine area, an auxiliary air suction opening is formed in the upper side of the fan area, and the upper ventilation area is in communication with said fan area through the auxiliary air suction opening.

3. An air-cooled type cooling system for an engine working machine assembly as recited in claim 2, wherein said exhaust air conduction passage is formed to extend horizontally from said fan area, the outlet of said exhaust air conduction passage is opened downwardly at the upper side of said muffler cooling air passage, and a guide plate for changing the flow direction of the exhaust air is provided at the upper side of the outlet of said exhaust air conduction passage and inside thereof for placement in the exhaust air flow.

* * * * *